US006465969B1

(12) United States Patent
Murasko et al.

(10) Patent No.: US 6,465,969 B1
(45) Date of Patent: Oct. 15, 2002

(54) ELECTROLUMINESCENT DISPLAY INTELLIGENT CONTROLLER

(75) Inventors: Matthew Murasko, Manhattan Beach, CA (US); Patrick J. Kinlen, Fenton, MO (US); Clarence H. Duttlinger, Jr., St. Charles, MO (US); Donald S. Landy, St. Louis, MO (US)

(73) Assignee: Lumimove, Inc., Fenton, MO (US)

( * ) Notice: Subject to any disclaimer, the term of this patent is extended or adjusted under 35 U.S.C. 154(b) by 0 days.

(21) Appl. No.: 09/814,674

(22) Filed: Mar. 22, 2001

Related U.S. Application Data

(63) Continuation-in-part of application No. 09/548,560, filed on Apr. 13, 2000, which is a continuation-in-part of application No. 08/905,528, filed on Aug. 4, 1997, now Pat. No. 6,203,391.

(51) Int. Cl.[7] ..... G09G 3/10

(52) U.S. Cl. ..... 315/169.3; 315/291; 315/224; 315/176

(58) Field of Search ..... 315/169.3, 224, 315/291, 307, 209 R, 174, 176

(56) References Cited

U.S. PATENT DOCUMENTS 4,386,351 A * 5/1983 Lowdenslager ..... 315/169.2
5,502,357 A * 3/1996 Kimball ..... 315/167
5,568,016 A * 10/1996 Beard ..... 315/169.3
6,157,138 A * 12/2000 Andersson ..... 315/160
6,310,589 B1 * 10/2001 Nishigaki et al. ..... 345/76
6,353,291 B1 * 3/2002 Borgogno et al. ..... 315/156

* cited by examiner

*Primary Examiner*—Haissa Philogene
(74) *Attorney, Agent, or Firm*—Lathrop & Gage L.C.

(57) ABSTRACT

The present invention includes a smart controller for electroluminescent lamps which compensates for a range of RC time constants and adjusts its output frequency accordingly such that a relatively uniform light output is obtained on all illuminated areas of large EL display panels. The controller incorporates a device which monitors the current as the pulse train is applied to the EL panel. A sensing circuit determines if the current decayed to zero during the positive portion of the pulse. If the current did not decay to zero, the frequency is decreased until a decay to zero is sensed. Uniform light output is thus maintained from panel to panel, regardless of RC time constant differences between different EL panels, or variations in panel electrical characteristics over time. In an alternate embodiment of the present invention, several different frequencies are applied to the EL panel nearly simultaneously. In this case the frequency that effectively controls the light output is determined by the RC time constant of the EL panel circuit.

37 Claims, 9 Drawing Sheets

ELECTROLUMINESCENT DISPLAY INTELLIGENT CONTROLLER

RELATED APPLICATIONS

The following application is a continuation-in-part of patent application Ser. No. 09,548,560, filed Apr. 13, 2000 which is a continuation-in-part of application Ser. No. 08/905528 filed Aug. 4, 1997 now U.S. Pat. No. 6,203,391.

FIELD OF THE INVENTION

This invention relates generally to electroluminescent lamps and, more particularly, to a controller for driving panels comprising such lamps at optimal frequencies.

BACKGROUND OF THE INVENTION

Electroluminescent Lamps:

An electroluminescent (EL) lamp generally includes a layer of phosphor positioned between two electrodes, and at least one of the electrodes is light-transmissive. At least one dielectric also is positioned between the electrodes so the EL lamp functions essentially as a capacitor. When a voltage is applied across the electrodes, the phosphor material is activated and emits a light.

EL lamps are typically manufactured as discrete cells on either rigid or flexible substrates. One known method of fabricating an EL lamp includes the steps of applying a coating of light-transmissive conductive material, such as indium tin oxide, to a rear surface of polyester film, applying a phosphor layer to the conductive material, applying at least one dielectric layer to the phosphor layer, applying a rear electrode to the dielectric layer, and applying an insulating layer to the rear electrode. The various layers may, for example, be laminated together utilizing heat and pressure. Alternatively, the various layers may be screen printed to each other. When a voltage is applied across the indium tin oxide and the rear electrode, the phosphor material is activated and emits a light which is visible through the polyester film.

Typically, it is not desirable for the entire EL polyester film to be light emitting. For example, if an EL lamp is configured to display a word, it is desirable for only the portions of the EL polyester film corresponding to letters in the word to be light emitting. Accordingly, the indium tin oxide is applied to the polyester film so that only the desired portions of the film will emit light. For example, the entire polyester film may be coated with indium tin oxide, and portions of the indium tin oxide may then be removed with an acid etch to leave behind discrete areas of illumination. Alternatively, an opaque ink may be printed on a front surface of the polyester film to prevent light from being emitted through the entire front surface of the film.

Fabricated EL lamps often are affixed to products, e.g., panels, and watches, to provide lighting for such products. For example, EL lamps typically are utilized to provide illuminated images on display panels. Particularly, and with respect to a display panel, EL lamps are bonded to the front surface of the display panel so that the light emitted by the phosphor layers of such lamps may be viewed from a position in front of the panel.

PROBLEM

Non-Uniform Illumination of Large Panel Areas:

Heretofore, electroluminescent (EL) display panels having lamp areas larger than about 20 square inches exhibit undesirable variations in light output over the surface of the panel. More specifically, the light output of a given EL panel fades noticeably from the center of the panel out to the periphery thereof, when driven by previously existing controllers.

A single, fixed frequency of 400 Hz or greater is typically employed by prior art EL panel controllers (drivers). For example, ENZ-Electronic AG (Gais, Switzerland) manufactures a number of different EL panel drivers intended for panel sizes (areas) ranging from 20 $cm^2$ to 1000 $cm^2$ (approximately 30 sq. in. to 155 sq. in.). Output frequencies for these drivers range from 200 Hz to 2800 Hz, with no apparent correlation between panel area and drive frequency. For example, various models of these drivers intended for 1200 $cm^2$ panels generate single frequencies ranging between 300 Hz and 800 Hz; drivers for 200 $cm^2$ panels generate single fixed frequencies ranging between 400 Hz and 1500 Hz; while a driver for an 850 $cm^2$ panel generates a frequency of 2800 Hz.

Any one of the previously available controllers is limited in its ability to uniformly illuminate a range of electroluminescent panels having areas of differing sizes.

Furthermore, variations in resistance and capacitance of the illumination and dielectric layers are inevitable in the panel printing process. In addition, as a panel ages, the electrical characteristics of the panel change. As a result, the panel light output is not constant over a period of time when driven by previously existing controllers.

Therefore, what is desired is a smart controller to drive an electroluminescent panel to produce an optimized uniform light output for a variety of illumination areas, capacitances, and resistances.

SOLUTION

In accordance with one aspect of the present invention, it was observed that the light output of electroluminescent (EL) devices is a function of not only the applied voltage and the illuminated area, but also a function of the frequency applied to the EL device. More specifically, it was noted that the light output of the EL panel begins to fade from the center of the circle out to the perimeter as the frequency is increased. This effect is mainly due to the RC time constant of the circuit, i.e., at higher frequencies, the effective capacitance of the circuit is not able to completely charge during the half cycle of the excitation wave.

The present invention includes a smart controller which compensates for a range of RC time constants and adjusts its output frequency accordingly such that a relatively uniform light output is obtained on all illuminated areas of large EL display panels. The controller incorporates a device which monitors the current as the pulse train is applied to the EL panel. A sensing circuit determines if the current decayed to near zero or about at least 60% of its initial value during the positive portion of the pulse. If the current did decay to near zero at a fixed base frequency (e.g. 400 Hz), no frequency adjustment is made. If it did not, the frequency is decreased until a decay to near zero current zero is sensed. This self-adjustment may be performed automatically and very rapidly through a continuous feedback loop so as not to be noticeable to the eye. Thus, uniform light output is maintained from panel to panel, regardless of RC time constant differences between different EL panels, or variations in panel electrical characteristics over time.

In an alternate embodiment of the present invention, several different frequencies are applied to the EL panel simultaneously. In this case the frequency that effectively controls the light output is determined by the RC time constant of the EL panel circuit. For higher time constants, a lower frequency is operational, for lower time constants a higher frequency is operational.

Intelligent controllers such as those described above are thus useful in maintaining a relatively constant light output as the panel ages and the RC time constant increases.

In one embodiment of the present invention, an electroluminescent panel includes an electroluminescent lamp formed integrally therewith. The electroluminescent lamp is formed on the panel by utilizing the panel as a substrate for the EL lamp. The panel is fabricated by utilizing the steps of screen printing a rear electrode to a front surface of the panel, screen printing at least one dielectric layer over the rear electrode after screen printing the rear electrode to the panel, screen printing a phosphor layer over the dielectric layer to define a desired area of illumination, screen printing a layer of indium. tin oxide ink to the phosphor layer, screen printing an outlining electrode layer to the panel that outlines the rear electrode, screen printing an outlining insulating layer to the outlining electrode layer, screen printing a background layer onto the panel so that the background layer substantially surrounds the desired area of illumination, and applying a protective coat over the indium tin oxide ink and background layer. The rear electrode of each lamp is screen printed directly to the front surface of the panel, and the other layers of the EL lamp are screen printed over the rear electrode.

The above described method provides an illuminated panel that does not require coupling prefabricated EL lamps to the panel. Such method also facilitates applying the various layers of the EL lamps to the EL substrate as a forward image and, alternatively, as a reverse image.

DETAILED DESCRIPTION OF THE INVENTION

Figure 1:
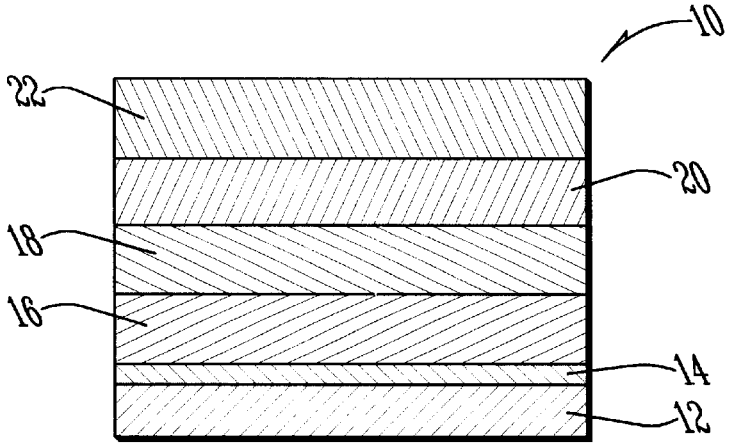
FIG. 1 is a schematic illustration of an electroluminescent lamp.

Electroluminescent Panel Fabrication:

FIG. 1 is a schematic illustration of an electroluminescent (EL) lamp 10 including a substrate 12 including a coating of light-transmissive conductive material, a front electrode 14, a phosphor layer 16, a dielectric layer 18, a rear electrode 20 of conductive particles, and a protective coating layer 22. Substrate 12 may, for example, be a poly(ethylene terephthalate) (PET) film coated with indium tin oxide (ITO). Front electrode 14 may be formed from silver particles. Phosphor layer 16 may be formed of electroluminescent phosphor particles, e.g., zinc sulfide doped with copper or manganese which are dispersed in a polymeric binder. Dielectric layer 18 may be formed of high dielectric constant material, such as barium titanate dispersed in a polymeric binder. Rear electrode 20 is formed of conductive particles, e.g., silver or carbon, dispersed in a polymeric binder to form a screen printable ink. Protective coating 22 may, for example, be an ultraviolet (UV) coating.

Figure 2:
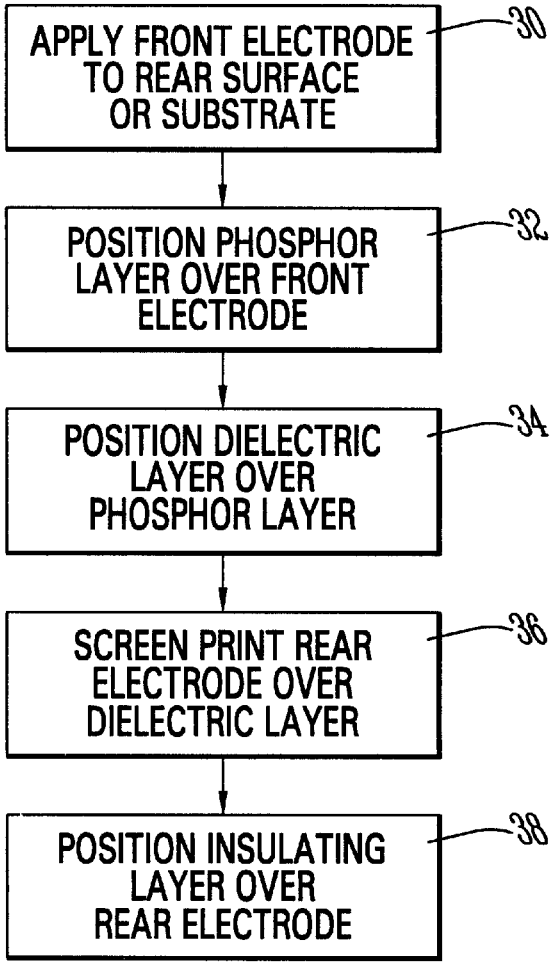
FIG. 2 is a flow chart illustrating a sequence of steps for fabricating the electroluminescent lamp shown in FIG. 1.

As shown in FIG. 2, EL lamp 10 is fabricated by applying 30 front electrode 14, e.g., silver particles, to a rear surface of substrate 12. For example, indium tin oxide may be sputtered onto the polyester film and then silver particles may be applied to the indium tin oxide. Phosphor layer 16 then is positioned 32 over front electrode 14, and dielectric layer 18 is positioned 34 over phosphor layer 16. Rear electrode 20 is then screen printed 36 over dielectric layer 18, and insulating layer 22 is positioned 38 over rear electrode 20 to substantially prevent possible shock hazard or to provide a moisture barrier to protect lamp 10. The various layers may, for example, be laminated together utilizing heat and pressure.

A background layer (not shown) is then applied to insulating layer 22. The background layer is applied to substrate 12 such that only the background layer and front electrode 14 are visible from a location facing a front surface of substrate 12. The background layer may include, for example, conventional UV screen printing ink and may be cured in a UV drier utilizing known panel screening practices.

Figure 3:
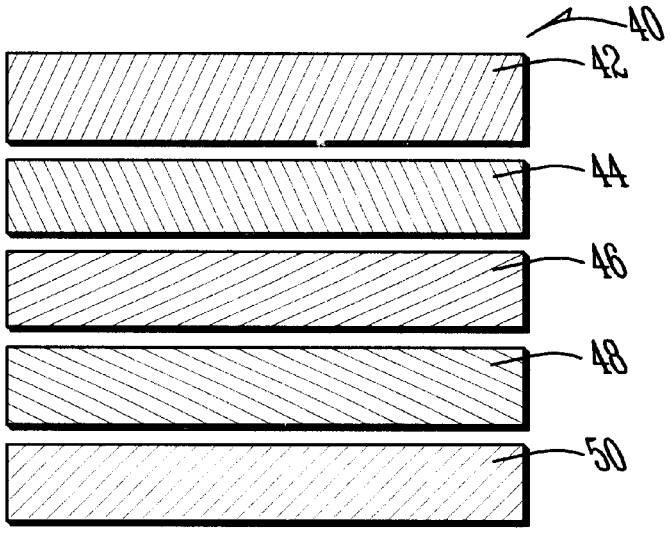
FIG. 3 is a schematic illustration of an electroluminescent lamp in accordance with one embodiment of the present invention.

FIG. 3 is a schematic illustration of an alternative electroluminescent (EL) lamp 40 including a substrate 42 including a coating of light-transmissive conductive material, a front electrode, 44, a phosphor layer 46, a dielectric layer 48, a rear electrode 50, and a protective coating layer (not shown). Substrate 42 may, for example, be a polyester film coated with indium tin oxide. Front electrode 44 may be formed from silver particles that form a screen printable ink which is UV curable such as Lumimove Conductor 101-UV available from Lumimove Company, 2685 Metro Blvd, St. Louis, Mo. 63043. Phosphor layer 46 may be formed of electroluminescent phosphor particles, e.g., zinc sulfide doped with copper or manganese which are dispersed in a polymeric binder to form a screen printable ink. In one embodiment, the phosphor screen printable ink may be UV curable such as Lumimove Light Particle 103-UV available from Lumimove Company, 2685 Metro Blvd, St. Louis, Mo. 63043.

Dielectric layer 48 may be formed of high dielectric constant material, such as barium titanate dispersed in a polymeric binder to form a screen printable ink. In one embodiment, the dielectric screen printable ink may be UV curable such as Lumimove Insulator 102-UV available from Lumimove Company, 2685 Metro Blvd, St. Louis, Mo. 63043. Rear electrode 50 is formed of conductive particles, e.g., silver or carbon, dispersed in a polymeric binder to form a screen printable ink. In one embodiment, rear electrode 50 may be UV curable such as Lumimove Particle Conductor 104-UV available from Lumimove Company, 2685 Metro Blvd, St. Louis, Mo. 63043. The protective coating may, for example, be an ultraviolet (UV) coating such as Lumimove Clear Coat Insulator 105-UV available from Lumimove Company, 2685 Metro Blvd, St. Louis, Mo. 63043.

In an alternative embodiment, EL lamp 40 does not include dielectric layer 48. Since the UV curable phosphor screen printable ink, i.e., Lumimove Light Particle 103-UV includes an insulator in the binder, EL lamp 40 does not require a separate dielectric layer over phosphor layer 46.

Figure 4:
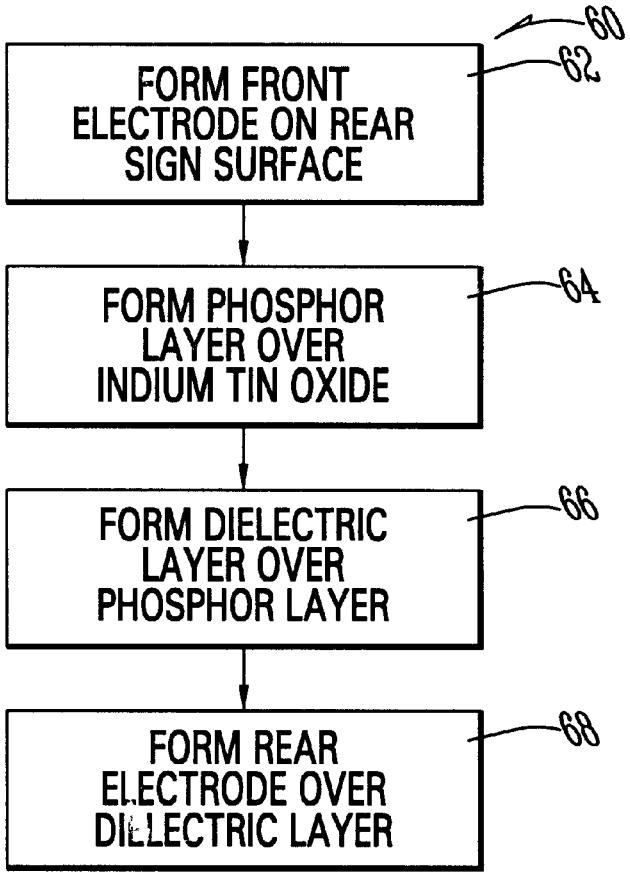
FIG. 4 is a flow chart illustrating a sequence of steps for fabricating the electroluminescent lamp shown in FIG. 3.

FIG. 4 illustrates a method 60 of fabricating EL lamp 40 (shown in FIG. 3). Front electrode 44 (shown in FIG. 3) defines an illumination area and is screen printed 62 onto an indium tin oxide coating on substrate 42 (shown in FIG. 3). After screen printing 62 front electrode 44, phosphor layer 46 (shown in FIG. 3) is screen printed 64 onto the indium tin oxide layer. Subsequently, dielectric layer 48 (shown in FIG. 3) is screen printed 66 onto phosphor layer 46. Front electrode 44 and phosphor layer 46 are configured to define a light emitting design. Rear electrode 50 (shown in FIG. 3) is screen printed 68 onto dielectric layer 48 to form EL lamp 40. In an alternative embodiment, EL lamp 40 does not include dielectric layer 48 and rear electrode 50 is screen printed onto phosphor layer 46.

Figure 5:
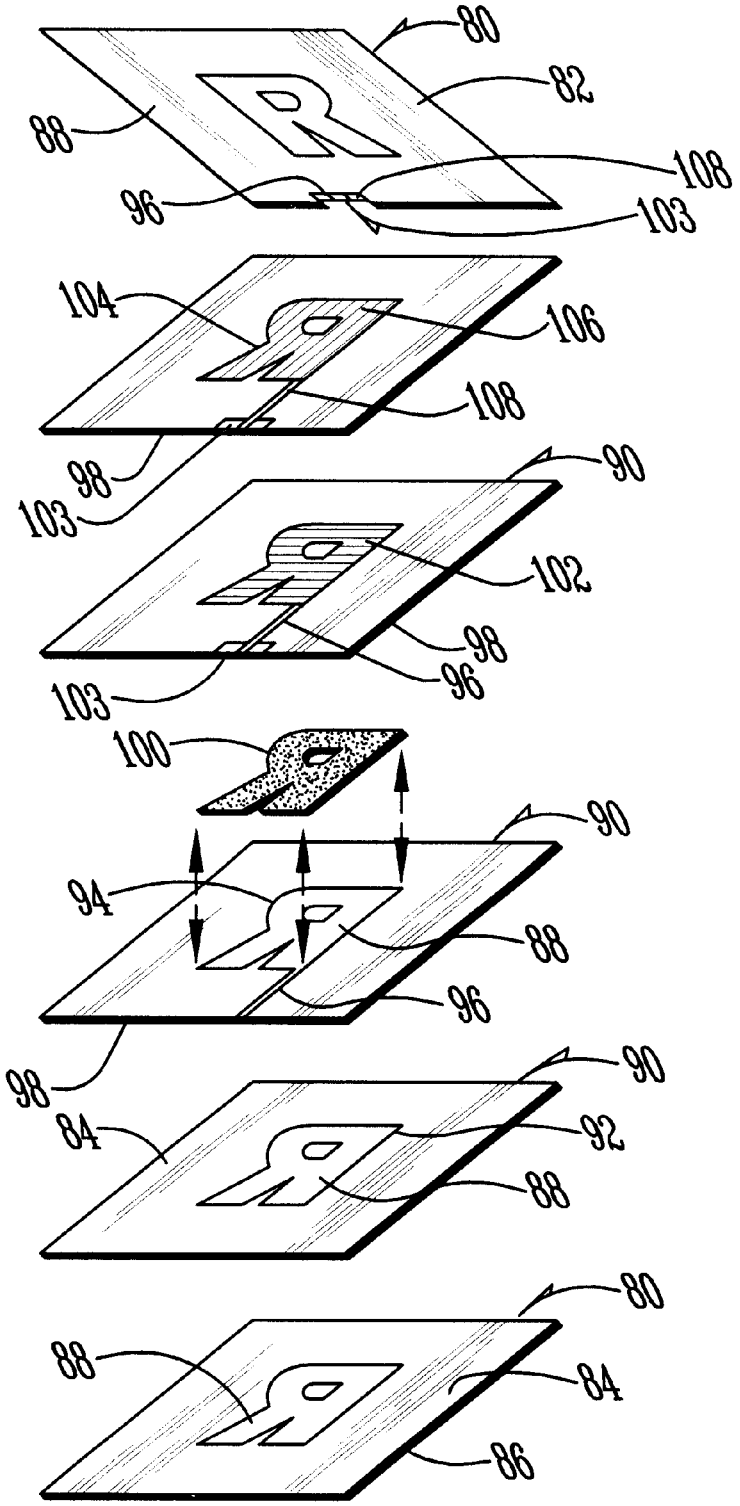
FIG. 5 is an exploded pictorial illustration of an EL lamp fabricated in accordance with the steps shown in FIG. 4.

More particularly, as shown in FIG. 5, a substantially clear heat stabilized polycarbonate substrate 80, e.g., a plastic substrate, having a front surface 82 and a rear surface 84 is first positioned in an automated flat bed screen printing press (not shown in FIG. 5). Substrate 80 includes a layer of ITO (indium tin oxide, a transparent conductor) and substrate 80 is positioned in the flat bed printing press such that the layer of ITO is facing up. A background substrate 86 is screen printed onto rear surface 84 and covers substantially entire rear surface 84 except for an illumination area 88 thereof. Illumination area 88 is shaped as a reverse image, e.g., a reverse image of "R", of a desired image to be illuminated, e.g., an "R".

A dielectric background layer 90 is then screen printed over panel rear surface 84 and background substrate 86. Dielectric background layer 90 covers substantially entire background substrate 86 and includes an illumination portion 92 which is substantially aligned with illumination area 88. In one embodiment, background layer 90 is a decorative layer utilizing UV four color process and substantially covers background substrate 86 except for illumination area 88.

Alternatively, the decorative layer is printed directly over illumination area 88 to provide a graduated, halftone, grainy illumination.

A front electrode 94 fabricated from silver ink is then screen printed onto panel rear surface 84 so that front electrode 94 contacts an outer perimeter of illumination portion 92. In addition, a lead 96 of front electrode 94 extends from the perimeter of illumination portion 92 to a perimeter 98 of EL lamp 40. Front electrode 94 is then UV cured for approximately two to five seconds under a UV lamp.

After screen printing front electrode 94 to panel surface 84, a phosphor layer 100 is screen printed over front electrode 94. Phosphor layer 100 is screened as a reverse image. Phosphor layer 100 is then UV cured, for example, for approximately two to five seconds under a UV lamp.

A dielectric layer 102 is then screen printed onto panel surface 84 so that dielectric layer 102 covers substantially the entire phosphor layer 100 and covers entirely front electrode 94 with the exception of an interconnect tab portion 103. In one embodiment, interconnect tab portion 103 is about 0.5 inches long by about 1.0 inches wide. Dielectric layer 102 includes two layers (not shown) of high dielectric constant material. The first layer of dielectric layer 102 is screen printed over phosphor layer 100 and is then UV cured to dry for approximately two to five seconds under a UV lamp. The second layer of dielectric layer 102 is screen printed over the first layer of barium titanate and UV cured to dry for approximately two to five seconds under a UV lamp to form dielectric layer 102. In accordance with one embodiment, dielectric layer 102 has substantially the same shape as illumination area 88, but is approximately 2% larger than illumination area 88 and is sized to cover at least a portion of front electrode lead 96.

A rear electrode 104 is screen printed to rear surface 84 over dielectric layer 102 and includes an illumination portion 106 and a rear electrode lead 108. Illumination portion 106 is substantially the same size and shape as illumination area 88, and rear electrode lead 108 extends from illumination portion 106 to panel perimeter 98. Art work used to create a screen for phosphor layer 100 is created using the same art work used to create a screen for rear electrode 104 except that the screen for rear electrode 104 does not include rear electrode lead 108. However, two different screens are utilized for phosphor layer 100 and rear electrode 104 since each one is for a different mesh count. Rear electrode 104, dielectric layer 102, phosphor layer 100, and front electrode 94 form EL lamp 40 extending from rear surface 84 of substrate 80.

In an alternative embodiment, EL lamp 40 does not include dielectric layer 102 since phosphor layer 100 includes an insulator in the UV phosphor binder. Rear electrode is then screen printed directly onto phosphor layer 100 and is substantially the same size and shape as illumination area 88.

Subsequently, a UV clear coat (not shown in FIG. 5) is screen printed to rear surface 84 and covers rear electrode 104, dielectric layer 102, phosphor layer 100, front electrode 94, dielectric background layer 90 and background layer 86. Particularly, the UV clear coat covers entire rear surface 84. In an alternative embodiment, the UV clear coat covers substantially entire rear surface 84 except for interconnect tab portion 103. Interconnect tab portion 103 is left uncovered to facilitate attachment of a slide connector (not shown) and a wire harness (not s own from a power supply (not shown) to front electrode lead 96 and rear electrode lead 108.

In an alternative embodiment, the EL panel includes a transparent reflective coating which is reflective to oncoming light, such as car headlights, in order to provide greater visibility of the panel at night. The transparent reflective coating is printed directly on the polycarbonate as the first layer of the panel. The transparent reflective coating allows the color details of EL panel to be visible to a person viewing the EL panel through the polycarbonate substrate.

Method 60 (shown in FIG. 4) provides a panel capable of illuminating via an EL lamp. The panel does not utilize coupling or laminating with heat, pressure, or adhesive, to attach by hand or other affixing method a prefabricated EL lamp to the panel.

Figure 6:
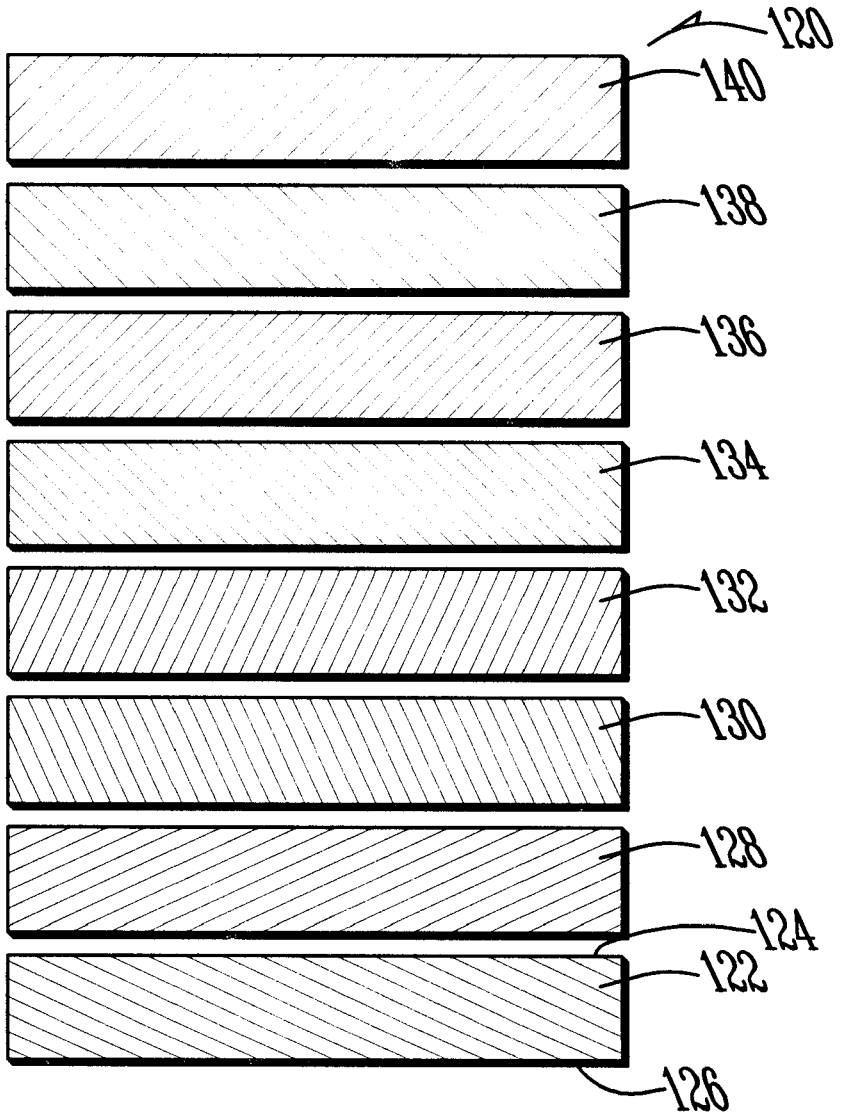
FIG. 6 is a schematic illustration of an electroluminescent lamp in accordance with an alternative embodiment of the present invention.

FIG. 6 is a schematic illustration of an alternative EL lamp 120 including a substrate 122. Substrate 122, in one embodiment, is a paper based substrate, such as card board or 80 point card stock, and includes a front surface 124 and a rear surface 126. A rear electrode 128 is formed on front surface 124 of substrate 122. Rear electrode 128 is formed of conductive particles, e.g., silver or carbon, dispersed in a polymeric binder to form a screen printable ink. In one embodiment, rear electrode 128 is heat curable such as Lumimove Particle Conductor 1004-HC available from Lumimove Company, 2685 Metro Blvd, St. Louis, Mo. 63043. In an alternative embodiment, rear electrode 128 is UV curable such as Lumimove Particle Conductor 104-UV available from Lumimove Company, 2685 Metro Blvd, St. Louis, Mo. 63043.

A dielectric layer 130 is formed over rear electrode 128 from high dielectric constant material, such as barium titanate dispersed in a polymeric binder to form a screen printable ink. In one embodiment, the dielectric screen printable ink is heat curable such as Lumimove Insulator102-HC available from Lumimove Company, 2685 Metro Blvd, St. Louis, Mo. 63043. In an alternative embodiment, dielectric layer 130 is UV curable such as Lumimove Insulator 102-UV available from Lumimove Company, 2685 Metro Blvd, St. Louis, Mo. 63043.

A phosphor layer 132 is formed over dielectric layer 130 and may be formed of electroluminescent phosphor particles, e.g., zinc sulfide doped with copper or manganese which are dispersed in a polymeric binder to form a screen printable ink. In one embodiment, the phosphor screen printable ink is heat curable such as Lumimove Light Particle 1003-HC available from Lumimove Company, 2685 Metro Blvd, St. Louis, Mo. 63043. In an alternative embodiment, phosphor layer 132 is UV curable such as Lumimove Light Particle 103-UV available from Lumimove Company, 2685 Metro Blvd, St. Louis, Mo. 63043.

A conductor layer 134 is formed on phosphor layer 132 from ITO particles that form a screen printable ink which is heat curable such as Lumimove Conductor 1001-HC available from Lumimove Company, 2685 Metro Blvd, St. Louis, Mo. 63043. In an alternative embodiment, conductor layer 134 is UV curable such as Lumimove Conductor 101-UV available from Lumimove Company, 2685 Metro Blvd, St. Louis, Mo. 63043.

A front outlining electrode 136 is formed on lamp 120 from silver particles that form a screen printable ink which is heat curable such as Lumimove Particle Conductor 1004-HC available from Lumimove Company, 2685 Metro Blvd, St. Louis, Mo. 63043. In an alternative embodiment, front outlining electrode 136 is UV curable such as Lumimove Particle Conductor 104-UV available from Lumimove Company, 2685 Metro Blvd, St. Louis, Mo. 63043.

A front outlining insulating layer 138 is formed over front outlining electrode 136 from high dielectric constant material, such as barium titanate dispersed in a polymeric binder to form a screen printable ink. In one embodiment, the front outlining insulator is heat curable such as Lumimove Insulator 1002-HC available from Lumimove Company, 2685 Metro Blvd, St. Louis, Mo. 63043. In an alternative embodiment, front outlining insulator 138 is UV curable such as Lumimove Insulator 102-UV available from Lumimove Company, 2685 Metro Blvd, St. Louis, Mo. 63043.

A protective coating 140 formed, for example, from a ultraviolet (UV) coating such as Lumimove Clear Coat Insulator 105-UV available from Lumimove Company, 2685 Metro Blvd, St. Louis, Mo. 63043 is then formed on lamp 120.

Figure 7:
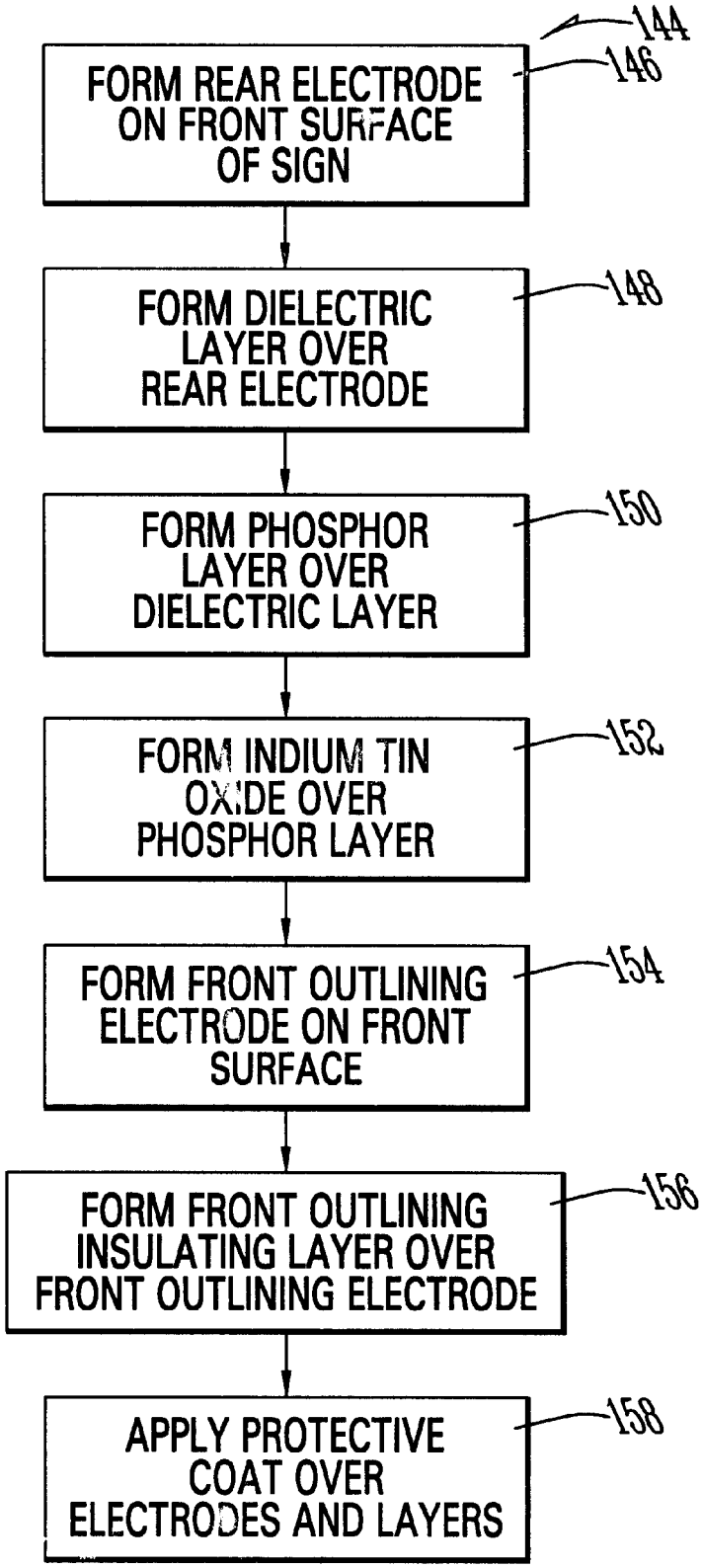
FIG. 7 is a flow chart illustrating a sequence of steps for fabricating the electroluminescent lamp shown in FIG. 6.

FIG. 7 illustrates a sequence of steps 140 for fabricating EL lamp 120. EL lamp 120 may, for example, have a metal substrate, e.g., 0.25 mm gauge aluminum, a plastic substrate, e.g., 0.15 mm heat stabilized polycarbonate, or a paper based substrate, e.g., 80 pt. card stock. With respect to an EL lamp utilizing a plastic substrate, a rear electrode is formed 142 on a front surface of EL lamp 120. Next, a dielectric layer is formed 144 over the rear electrode. Subsequently, a phosphor layer is formed 146 over the dielectric layer. A layer of indium tin oxide ink is formed 148 over the phosphor layer, a front outlining electrode is then formed 150 on the front surface and a front outlining insulating layer is formed 152 on the front outlining electrode layer. A protective coat is then applied 154 over the electrodes and layers.

Figure 8:
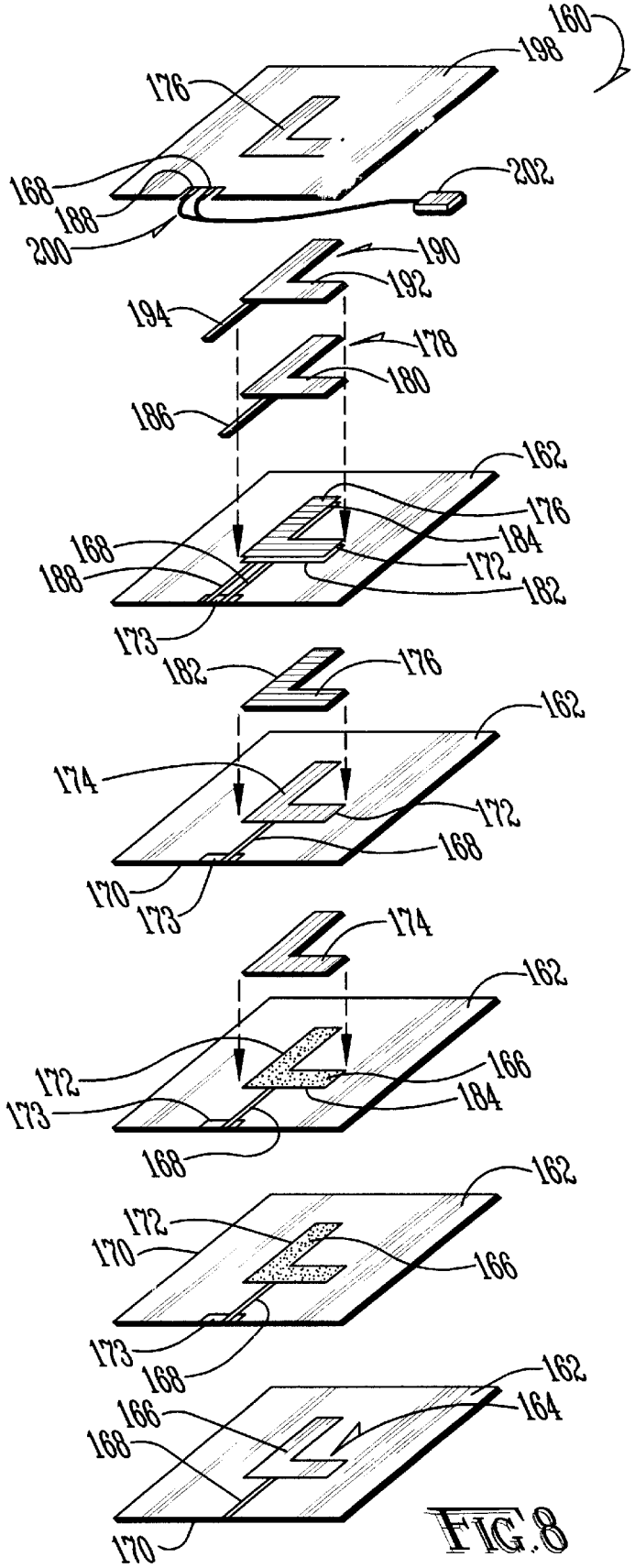
FIG. 8 is an exploded pictorial illustration of an EL lamp fabricated in accordance with the steps shown in FIG. 7.

More particularly, as shown in FIG. 8, an EL panel 160, e.g., a lamp having a plastic substrate including a front surface 162 and a rear surface (not shown) is first positioned in an automated flat bed screen printing press (not shown). A rear electrode 164, such as screen printable carbon or silver, having an illumination area 166 and a rear electrode lead 168 is screen printed onto front surface 162 of panel 160. Illumination area 166 defines a light emitting design, or shape, e.g., an "L", representative of the ultimate image to be illuminated by panel 160.

Rear electrode lead 168 extends from illumination area 166 to a perimeter 170 of panel front surface 162. Rear electrode 164 is screen printed as a positive, or forward, image, e.g., as "L" rather than as a reverse "L". After printing rear electrode 164 on front surface 162, rear electrode 164 is cured to dry. For example, rear electrode 164 and panel 160 may be positioned in a reel to reel oven for approximately two minutes at a temperature of about 250–350 degrees Fahrenheit. In an alternative embodiment, rear electrode 164 and panel 160 are cured by exposure to UV light for about two to about five seconds.

In one embodiment, rear electrode 164 is screen printed in halftones to vary the light emitting characteristics of panel 160. In one embodiment, the amount of silver utilized in the halftone rear electrode layer varies from about 100% to about 0%. The rear electrode silver halftone area provides a fading of the silver particles from a first area of total coverage to a second area of no coverage which allows for dynamic effects such as the simulation of a setting sun.

A dielectric layer 172 is then screen printed onto lamp surface 162 so that dielectric layer 172 covers substantially the entire illumination area 166 while leaving rear electrode lead 168 covered entirely except for an interconnect tab portion 173. In one embodiment, interconnect tab portion 173 is about 0.5 inches wide by about 1.0 inch long. Dielectric layer 172 includes two layers (not shown) of high dielectric constant material, such as barium titanate dispersed in a polymeric binder. The first layer of barium titanate is screen printed over rear electrode 164 and cured to dry for approximately two minutes at a temperature of about 250–350 degrees Fahrenheit. In an alternative embodiment, the first layer of barium titanate is cured by exposure to UV light for about two to about five seconds.

The second layer of barium titanate is screen printed over the first layer of barium titanate and cured to dry for approximately two minutes at a temperature of about 250–350 degrees Fahrenheit to form dielectric layer 172. In an alternative embodiment, the second layer of barium titanate is cured by exposure to UV light for about two to about five seconds. In accordance with one embodiment, dielectric layer 172 has substantially the same shape as illumination area 166, but is approximately 2% larger than illumination area 166.

In an alternative embodiment, dielectric layer includes a high dielectric constant material such as alumina oxide dispersed in a polymeric binder. The alumina oxide layer is screen printed over rear electrode 164 and cured by exposure to UV light for about two to about five seconds.

After screen printing dielectric layer 172 and rear electrode 164 to lamp surface 162, a phosphor layer 174 is screen printed onto panel surface 162 over dielectric layer 172. Phosphor layer 174 is screened as a forward, or positive, image, e.g., as "L", rather than a reverse image, e.g., as a reverse image of "L", and has substantially the same shape and size as illumination area 166. Art work utilized to create a screen for phosphor layer 174 is the same art work utilized to create a screen for rear electrode 164, except for rear electrode lead 168. However, two different screens are utilized for phosphor layer 174 and rear electrode 164 since each screen is specific to a different mesh count. Phosphor layer 174 is then cured, for example, for approximately two minutes at about 250–350 degrees Fahrenheit. In an alternative embodiment, phosphor layer 174 is cured by exposure to UV light for about two to about five seconds.

In one embodiment, phosphor layer 174 is screen printed in halftones to vary the light emitting characteristics of panel 160. In one embodiment, the amount of phosphor utilized in the halftone phosphor layer varies from about 100% to about 0%. The halftone area provides a fading of the light particles from a first area of total brightness to a second area of no brightness which allows for dynamic effects such as the simulation of a setting sun.

A conductor layer 176 formed from ITO is screen printed over phosphor layer 174. Conductor layer 176 has substantially the same shape and size as illumination area 166 and may, for example, be screen printed with the same screen utilized to print phosphor layer 174. Conductor layer 176 also is printed as a forward image and is cured, for example, for approximately two minutes at about 250–350 degrees Fahrenheit. In an alternative embodiment, conductor layer 176 is cured by exposure to UV light for about two to about five seconds.

In one embodiment, conductor layer is non-metallic and is translucent and transparent, and is synthesized from a conductive polymer, e.g., poly-phenyleneamine-imine. The non-metallic conductor layer is heat cured for approximately two minutes at about 200 degrees Fahrenheit.

Subsequently, a front electrode, bus bar, or front outlining electrode layer 178 fabricated from silver ink is screen printed onto lamp panel surface 162 and is configured to transport energy to conductor layer 176. Particularly, front electrode 178 is screen printed to lamp surface 162 so that a first portion 180 of front outlining electrode layer 178 contacts an outer perimeter 182 of conductor layer 176. In addition, first portion 180 contacts an outer perimeter 184 of illumination area 166 and an outer perimeter 186 of a front electrode lead 188 which extends from illumination area 166 to perimeter 170 of panel surface 162. Front outlining electrode layer 178 is then cured for approximately two minutes at about 250–350 degrees Fahrenheit. In an alternative embodiment, front outlining electrode layer 178 is cured by exposure to UV light for about two to about five seconds.

In one embodiment, front outlining electrode layer 178 contacts substantially the entire outer perimeter 182 of conductor layer 176 and does not overlap rear electrode 164. In an alternative embodiment, front electrode first portion 180 contacts only about 25% of outer perimeter 182 of conductor layer 176. Of course, front electrode first portion 180 could contact any amount of the outer perimeter of conductor layer 176 from about 25% to about 100%.

In an alternative embodiment, the order of application of conductor layer 176 and front outlining electrode layer 178 is reversed such that front outlining electrode layer 176 is applied immediately after phosphor layer 174 is applied, and conductor layer 176 is applied after front outlining electrode layer 178. A front outlining insulator layer 190 is then applied immediately after conductor layer 176.

A front outlining insulator layer 190 is screen printed onto front outlining electrode layer 178 and covers front outlining electrode 178 and extends beyond both sides of front outlining electrode by about 0.125 inches. Front outlining insulator layer 190 is a high dielectric constant material, such as barium titanate dispersed in a polymeric binder. Front outlining insulator layer 190 is screen printed onto front outlining electrode layer 178 such that front outlining insulator layer 190 covers substantially the entire front outlining electrode layer 178. Front outlining insulator layer 190 is cured for approximately two minutes at about 250–350 degrees Fahrenheit. In an alternative embodiment, front outlining insulator layer 190 is cured by exposure to UV light for about two to about five seconds.

The size of front outlining insulating layer 190 depends on the size of front outlining electrode layer 178. Front outlining electrode layer 190 thus includes a first portion 192 that substantially covers front outlining electrode layer first portion 180 and a second portion 194 that substantially covers front electrode lead 188 which extends from illumination area 166 to perimeter 170 of lamp 162. Interconnect tab portion 173 of front electrode lead 188 remains uncovered so that a power source 196 can be connected thereto. Rear electrode 164, dielectric layer 172, phosphor layer 174, conductor layer 176, front outlining electrode layer 178, and front outlining insulating layer 190 form EL panel 160 extending from front surface 162 of the substrate.

A decorative background layer 198 utilizing a four color process is then screen printed on front surface 162 of panel 160. Background layer 198 substantially covers front surface 162 except for illumination area 166 and tab interconnect portion 173. However, in some cases, background layer 198 is printed directly over illumination area 166 to provide a gradated, halftone, grainy illumination quality.

Particularly, background layer 198 is screen printed on front surface 162 so that substantially only background layer 198 and conductor layer 176 are visible from a location facing front surface 162. Background layer 198 may include, for example, conventional UV screen printing ink and may be cured in a UV dryer utilizing known panel screening practices.

In one embodiment, background layer 198 is screen printed in halftones to vary the light emitting characteristics of panel 160. In one embodiment, the amount of ink utilized in the halftone background layer varies from about 100% to about 0%. The halftone area provides a fading of the coloration from a first area of total coverage to a second area of no coverage which allows for dynamic coloration effects.

In one embodiment, a thennochromatic ink, available from Matsui Chemical Company, Japan, is used in place of the four color process from background layer 198. The thermochrornatic ink is utilized to print the background of EL panel 160. Once printed in the thennochromatic ink, the background design will change colors due to the temperature of EL panel 160.

For example, an EL panel originally includes a background, printed with a yellow thermochromatic ink, a first shape, and a second shape printed thereon. Both shapes are printed with phosphor, allowing the shapes to illuminate when connected to a power supply. In addition, the first shape is overprinted with a blue thermochromatic ink and the second shape is overprinted with a red thermochromatic ink. As the temperature of the panel increases, the first shape changes from blue to purple and the second shape changes from red to blue. In addition, the background changes from yellow to green as the temperature of the panel increases. Then when the temperature of the panel decreases, the colors revert back to their original color, i.e., the first shape changes from purple to blue, the second shape changes from blue to red, and the background changes from green to yellow.

In an alternative embodiment, a white filtering layer (not shown) is applied directly onto front outlining insulating layer 190. The filtering layer is between approximately 60% to approximately 90% translucent and allows illumination to pass through the filter while the panel is in the 'off' state. The white filtering layer provides a white appearance to any graphics underneath the filtering layer. The filtering layer, in one embodiment, is applied using a 305 polyester mesh and screen printing technique and includes about 20% to about 40% Nazdar 3200 UV white ink and about 60% to about 80% Nazdar 3200 mixing clear, which are available from Nazdar, Inc., Kansas City, Mo.

In a further alternative embodiment, after screening background layer 198 onto front surface 162, a UV coating (not shown) is applied to panel 160. Particularly, the UV coating is applied to cover entire front surface 162 of panel 50 and to provide protection to the EL lamp. A protective coating (not shown) is then printed directly over background layer 198. The protective coating protects the integrity and color stability of the inks used in the other layers, especially background layer 198. The protective coating reduces fading of background layer 198 and protects panel 160 from UV radiation. The protective coating is transparent and provides an insulative property to panel 160 due to the insulative effects of the binder used on the ink.

Similarly, front surface 162 of panel 160 may be coated with a UV coating before applying rear electrode 164 to front surface 162. For example, a UV coating is first applied to front surface 162 to substantially ensure the integrity of the EL lamp layers, e.g., to substantially prevent the plastic substrate from absorbing the screen printable inks.

In a further alternative embodiment, a transparent reflective coating is applied to the protective coating layer. The transparent reflective coating allows the color details of the four color background layer to be visible to a person viewing EL panel 160. The transparent reflective coating is reflective to oncoming light, such as car headlights in order to provide greater visibility of the panel at night. Exemplary uses of an EL panel which includes the reflective coating layer are street panels, billboards, and bicycle helmets. In addition, an EL panel utilizing the reflective layer could be used in any application where the panel will be viewed via a light. An exemplary transparent coating is Reflect-illum- available from Lumimove Company, 2685 Metro Blvd, St. Louis, Mo. 63043.

In a still further alternative embodiment, the EL panel does not include a decorative background layer. Instead, the protective clear coat is applied directly over the front outlining insulator layer and the transparent reflective coating is applied directly over the protective insulative coat.

In another embodiment, a holographic image (not shown) is formed in place of the four color process used for background layer 198. The holographic image provides the EL panel with the illusion of depth and dimension on a surface that is actually flat. The holographic image, in one embodiment, is applied to the EL panel over the four color process to provide an added dimension to the panel. In an alternative embodiment, the holographic image is applied over the clear coat insulative layer.

After applying rear electrode 164, dielectric layer 172, phosphor layer 174, conductor layer 176, front outlining electrode layer 178, front outlining insulating layer 190, and background layer 198 to panel 160, panel 160 may, for example, be hung in a window, on a wall, or suspended from a ceiling. Power supply 202 is then coupled to front electrode lead 188 and rear electrode lead 168 and a voltage is applied across rear electrode 164 and front electrode 178 to activate phosphor layer 174. Particularly, current is transmitted through front electrode 178 to conductor layer 176, and through rear electrode 164 to illumination area 166 to illuminate the letter "L". EL panel 160 is formed with multiple inks that bond together into a non-monolithic structure. The inks are either heat cured or they are UV cured. In addition, certain layers of EL panel 160 can be heat cured while other layers of the same EL panel 160 can be UV cured.

In accordance with one embodiment, rear electrode 164 is approximately 0.6 millimeters thick, dielectric layer 172 is approximately 1.2 millimeters thick, phosphor layer 174 is approximately 1.6 millimeters thick, conductor layer 176 is approximately 1.6 millimeters thick, front electrode 178 is approximately 0.6 millimeters thick, and background layer 184 is approximately 0.6 millimeters thick. Of course, each of the various thicknesses may vary.

Interconnect tab portion 173 is adjacent panel perimeter 170 and remains uncovered to facilitate attachment of a slide connector 200 and wire harness from a power supply 202 to front electrode lead 188 and rear electrode lead 168. In one embodiment, tab interconnect portion 173 is die cut to provide a mating fit of slide connector 200 onto tab interconnect portion 173. The die cut provides interconnect tab portion 173 with a slot configuration and slide connector 200 includes a pin configuration which ensures that slide connector 200 is properly oriented on tab interconnect portion 173. In one embodiment, slide connector 200 is fixedly attached to interconnect tab portion 173 with screws or other fasteners. Slide connector 200 entirely surrounds exposed leads 168 and 188, i.e., that portion of leads 168 and 188 that have been left uncovered.

In one embodiment, after EL panel 160 has been formed, panel 160 is then vacuum formed as follows. panel 160, in an exemplary embodiment, includes a clear polycarbonate substrate between about 0.01 and 0.05 inches thick and has a size of about one foot by about one foot to about 10 feet by about 15 feet. panel 160 also includes an insulative clear coat printed on a back of the substrate, as described above. panel 160 is then placed in a vacuum form type machine such as a Qvac PC 2430PD, A mandrel mold is fabricated with peaks and valleys and includes draw depths between about 0 inches and about 24 inches. The mold is utilized on products including, but not limited to, helmets, three dimensional advertising panels, fenders, backpacks, automobile parts, furniture and sculptures.

Sign 160 is inserted into the vacuum form machine with the positive image facing up panel 160 is then heated for an appropriate time such as about two to about 30 seconds depending upon substrate thickness, i.e., more time is needed for thicker substrates. Once panel 160 is heated for the proper length of time, panel 160 is mechanically pulled down onto the mandrel mold which applies a vacuum pull in two places, a bottom of the vacuum form face, and through openings in the mandrel mold that allow for even pressure pull to panel 160. panel 160 is then formed in the desired shape of the mandrel mold. Air pressure is then reversed through the openings utilized to create the vacuum which releases panel 160 from the mold.

In a further embodiment, panel 160 is formed on a metal substrate and is embossed so that panel front surface 162 is not planar. Particularly, panel 160 is embossed so that illumination area 166 projects forward with respect to panel outer perimeter 170. In an alternative embodiment, panel 160 is embossed so that one portion of illumination area 166, e.g., the short leg of "L", projects forward with respect to another portion or illumination area 166, e.g., the long leg of "L". In an exemplary embodiment, panel 160 is positioned in a metal press configured to deliver five tons of pressure per square inch to form dimples in panel front surface 162.

Intelligent Eectroluminescent Panel Controller:

In accordance with one aspect of the present invention, it was observed that the light output of electroluminescent (EL) devices is a function of not only the applied voltage and the illuminated area, but also a function of the frequency applied to the EL device. A square wave was employed at 340 V p-p (peak-to-peak) to excite circles with various areas (2, 8, 25, and 50 square inches), and a light output chart plot was generated at frequencies from 100 to 1000 Hz. The light output was measured in the center area of the circle.

In EL panels having areas larger than about 20 square inches, it was observed that the light output of a given EL panel decreased as the applied frequency is increased. More specifically, it was noted that the light output of the EL panel begins to fade from the center of the circle out to the perimeter as the frequency is increased. This effect is mainly due to the RC time constant of the circuit, i.e. at higher frequencies, the effective capacitance of the circuit is not able to completely charge during the half cycle of the excitation wave. The contribution to R is mainly due to the resistance of the ITO, with smaller contributions to resistance coming from the front and rear electrode leads. The capacitance is a function of the area of the electrode forming the illumination layer and the dielectric constant of the dielectric layer and phosphor layers combined.

One of the functions of the present controller advantageously utilizes the above observations to monitor the current during operation of an electroluminescent device in order to measure the decay of current with time. The present invention includes an intelligent controller which compensates for a range of RC time constants and adjusts its output frequency accordingly such that a relatively uniform light output is obtained on all illuminated areas of large EL display panels. An additional advantage of the intelligent controllers described herein is that a relatively constant light output is produced by a given panel as the panel ages and its RC time constant increases.

Figure 9:
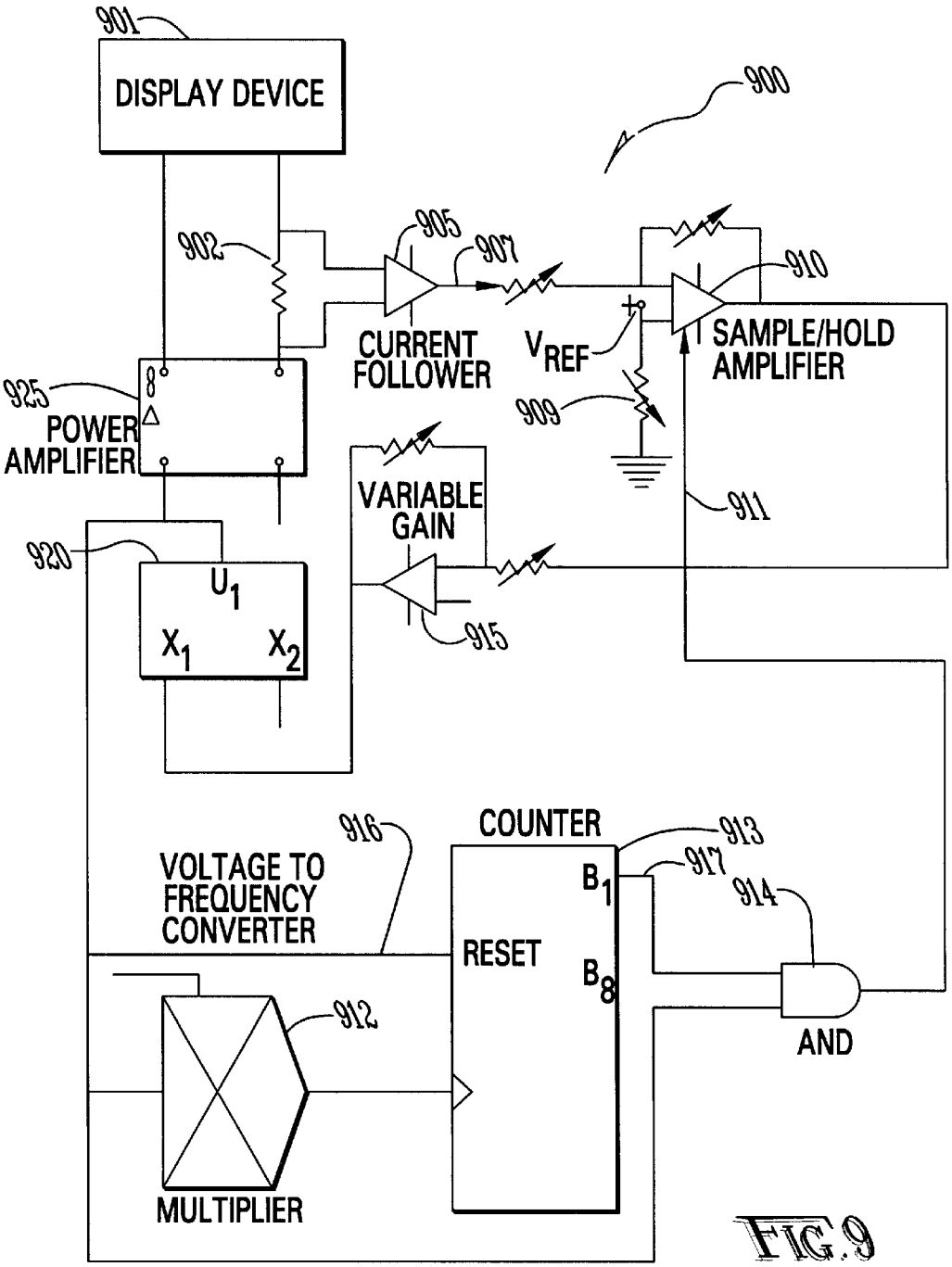
FIG. 9 is a schematic illustration of an EL lamp controller in accordance with one embodiment of the present invention.
Figure 10:
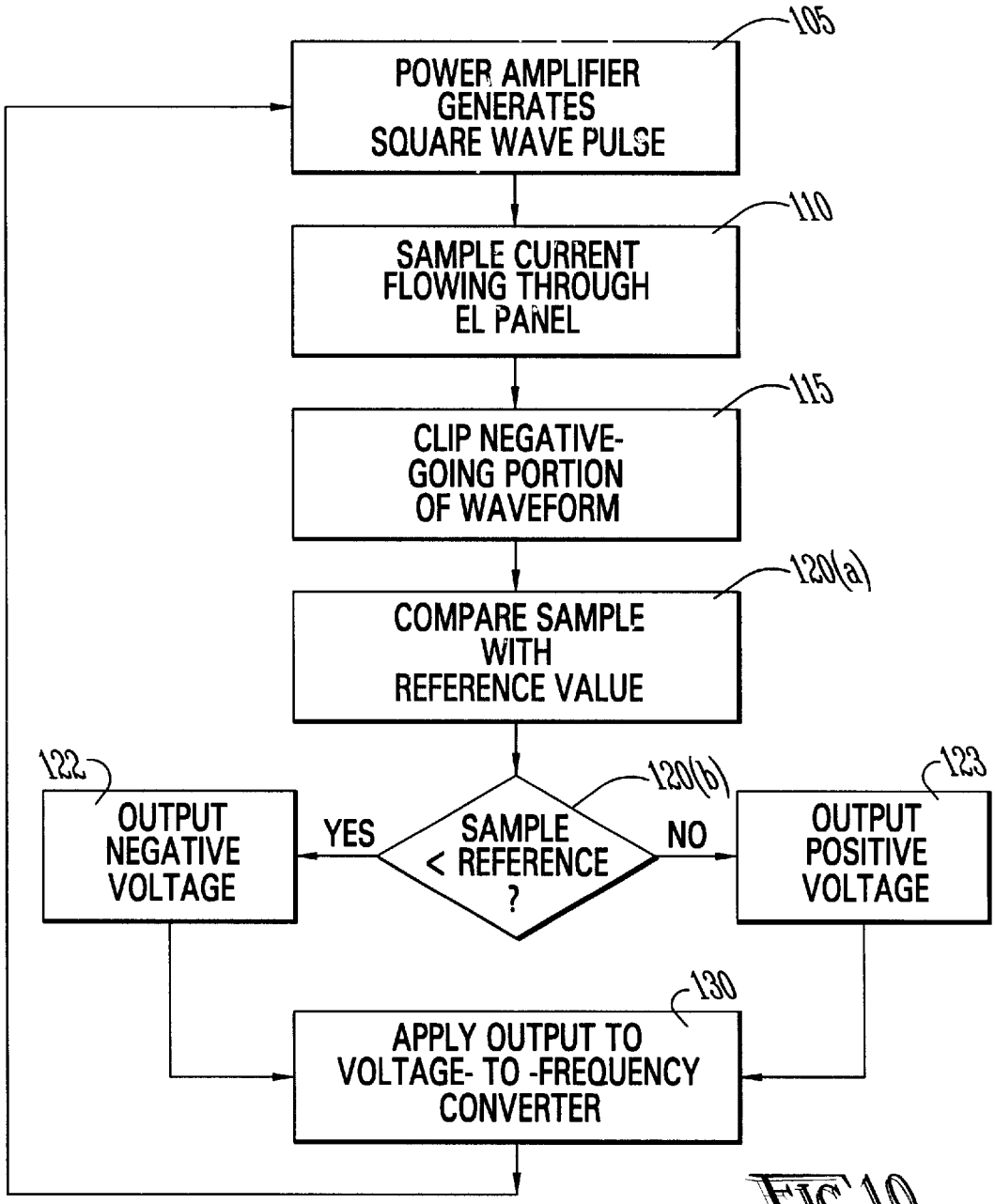
FIG. 10 is a flowchart illustrating an exemplary sequence of steps performed by the controller shown in FIG. 9.

The present EL controller incorporates a feedback loop which monitors the current in a pulse train applied to an electroluminescent lamp or lamp panel. FIG. 9 is a schematic illustration of an intelligent EL lamp controller 900 in accordance with an exemplary embodiment of the present invention, and FIG. 10 is a flowchart illustrating an exemplary sequence of steps performed by the controller 900. Operation of the controller is best understood by viewing FIGS. 9 and 10 in conjunction with one another.

At step 105, a power amplifier 925 generates a square wave pulse which is applied to an electroluminescent lamp panel ('display panel') 901 to produce the illumination thereof. The pulse is typically in the range of 38 volts p-p to 500 volts p-p at frequencies ranging from 10 Hz to 4 KHz, but any voltage appropriate for the particular display panel 901 could alternatively be employed by the present controller 900. Although the drive signal applied to display device 901 is typically a square wave or other bipolar pulsatile waveform, alternative waveforms, such as sinusoidal, triangle, or sawtooth waveforms could instead be generated by amplifier 925. The frequency of the waveform that is output by amplifier 925 is determined by the signal applied thereto by a voltage-to frequency converter 920. At step 110, the current decay through electroluminescent display panel 901 is monitored with a current follower 905, which samples the current flowing through a resistive load 902. Note that display panel 901 can be any electroluminescent display device, including the EL display devices 10, 40, 120, and 160 described above.

The negative going portion of the sampled waveform is then clipped (i.e., eliminated) at the output of the current follower, at step 115, with a diode clipping circuit (not shown). See, for example, "Electronics for Scientists and Engineers", by Ralph R. Benedict, Prentice Hall, New Jersey, 1967, page 408. The maximum current is estimated to occur at the time of application of the leading edge of the pulse. This is typically in the range of about 100 mA. The current then decays as 1/RC, where R is the resistance of display element 901 and C is the capacitance thereof. What is desired is that the current decays to a predetermined endpoint reference value of approximately 1 mA or less during the pulse width of the positive pulse before the polarity is switched, although the present system will function with other endpoint values with less efficient results as the endpoint value is increased.

At step 120(*a*), sample and hold amplifier 910 then compares the sampled current flow with a predetermined endpoint reference value. In the presently described embodiment, the endpoint value is approximately 1 mA. As explained below, the circuit shown in FIG. 9 increases or decreases the output frequency of intelligent controller 900 from a predetermined base frequency, e.g., 400 Hz, to provide more effective and uniform illumination of display panel 901. This circuit also allows for adjustment of the timing of the current measurement of controller 900.

In accordance with an exemplary embodiment, sample and hold amplifier 910 is a differential amplifier whose output is a continuous voltage proportional to the difference that exists between the input signal 907 from current follower 905 and a reference signal $V_{REF}$ when a gating (sampling) signal 911 is applied to the amplifier. The zero point or crossover point is set by potentiometer 909 to provide reference signal $V_{REF}$, which is a small positive reference voltage that is fed into the non-inverting input of amplifier 910. The input 907 from current follower 905 is fed into the inverting input of the differential amplifier 910. If the input voltage 907 from current follower 905 is greater than the reference voltage, a negative voltage is output from amplifier 910 (since the signal is inverted). If the input voltage 907 is less, a positive output is generated. Since variable gain amplifier 915 inverts the signal again, current greater than a value (1 mA, for example) generates a positive signal to voltage-to-frequency converter 920, and vice-versa.

The output voltage from amplifier 910 is applied to voltage-to-frequency converter 920 via a variable gain amplifier 915, which balances the output from amplifier 910 such that the output falls within the input voltage range of the voltage-to-frequency converter. Therefore, the output frequency of voltage-to-frequency converter 920 moves in a positive or negative direction from a base frequency (e.g., 400 Hz), depending on the relative values of input signal 907 and reference signal $V_{REF}$.

Assuming that at least one of the inputs to the sample and hold amplifier 910 changes, the output of amplifier 910 changes on every half cycle of the pulse output from power amplifier 925. The timing of the input sampling of amplifier 910 is determined by frequency multiplier 912 and counter 913. Counter 913 has its reset line 916 coupled to the output of voltage-to-frequency converter 920, and its output 917 connected to AND gate 914, which insures the counter is reset on the positive-going portion of each half cycle of the pulse. Output 911 of AND gate 914 is applied to the sampling gate of sample and hold amplifier 910 to cause the amplifier to compare (sample) the inputs thereto and lock (hold) the output thereof until a subsequent gating signal 911 is received. In one embodiment, the controller output base frequency is multiplied by a factor of 10 by multiplier 912, and 4 pulses counted by counter 913. The resultant signal is then applied to sample and hold amplifier 910 via output 911 of AND gate 914, to control the sampling interval of the amplifier. This particular combination of multiplier and pulse count values provides a current measurement at 4/5 the pulse width. Other multiplier values and counters could also be used to move the sampling time anywhere within the pulse.

Next, at step 120(*b*), if the sampled current is less than the reference (i.e., if the input voltage 907 from current follower 905 is greater than $V_{REF}$), a negative voltage is output from sample and hold amplifier 910 (step 122); otherwise, a positive voltage is output from the amplifier (step 123). At step 130, if a positive voltage is output from sample and hold amplifier 910, a positive voltage is applied to voltage-to-frequency converter 920, causing the output of the voltage-to-frequency converter to move to a lower frequency, for example, a delta frequency of 10 Hz per step. If a negative voltage is output from sample and hold amplifier 910, a negative voltage is applied to voltage-to-frequency converter 920, causing the output thereof to move to a higher frequency. Thus, if the current being sampled did not decay to a value approximately equal to the endpoint reference value within a predetermined time, e.g., at the 4/5 pulse width measurement point, the frequency is successively increased or decreased until a differential of zero volts between the inputs to sample and hold amplifier 910 is sensed or until a predetermined upper/lower frequency limit (for example, either approximately 2 KHz or 50 Hz is reached; i.e., until one of the frequency bounds of power amplifier 925 or voltage-to-frequency converter 920 is encountered.

The loop is closed at step 105, where the wave form is amplified by power amplifier 925, and applied to the display device 901. The above-described self-adjustment may be performed in less than a second, as not to be noticeable to the eye. Thus, a relatively uniform light output is maintained from one EL display panel to another, regardless of the RC time constant differences between different panels, or variations in panel electrical characteristics over time.

In an alternative embodiment of the present invention, multiple frequencies are generated and applied to an electroluminescent display device. The advantages of application of multiple frequencies to an EL panel may be better understood by reference to Table 1, below, which shows typical RC time constants of printed circular EL panels having various areas:

TABLE 1

| Area of EL Panel (square inches) | Resistance to center Of ITO (K Ohms) | Capacitance of stack (nF) | R*C (seconds) |
|---|---|---|---|
| 50 | 15 | 152 | .0023 |
| 25 | 13 | 96 | .0012 |
| 8 | 13 | 34 | .00044 |
| 2 | 9 | 10 | .00009 |

As long as the RC time constant is smaller than the wave form period, uniform light output is obtained. The period of a 400 Hz pulse is 0.00125 seconds, which is smaller than the time constant (0.0023) of the large (50 sq. in.) circular panel, as indicated in Table 1. The 50 sq. in. circular panel is dim in the center when driven at a 400 Hz frequency. If, however, the pulse frequency is lowered to, for example, 200 Hz, the period is 0.0025 seconds which is on the order of the panel's RC value, thereby producing a relatively uniform illumination of the circle. In general, Low frequencies more effectively and uniformly illuminate larger areas than high frequencies.

Figure 11:
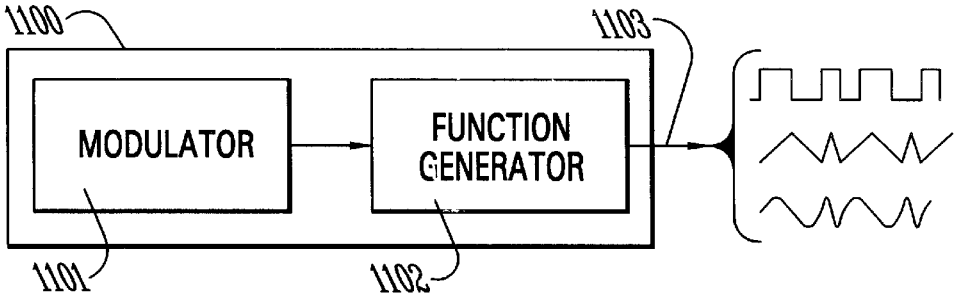
FIG. 11 is a schematic illustration of an EL lamp controller in accordance with an alternative embodiment of the present invention.

FIG. 11 is a schematic illustration of an electroluminescent lamp controller 1100 in accordance with an alternative embodiment of the present invention. As shown in FIG. 11, the output of modulator 1101 is applied to flnction generator 1102 to generate a triangle, square or other wave form output 1103, the frequency of which corresponds with the modulating input from modulator 1101. Output 1103 is connected to an electroluminescent lamp panel such as the EL display devices 10, 40, 120, and 160 described above, but controller 1100 can also be used to illuminate other types of electroluminescent display panels.

In accordance with one embodiment, modulator 1101 produces two or more different frequencies, one at a time, in a recurring (cyclical) fashion. Modulator 1101 thus functions, in effect, as a multiplexer, in that it repetitively produces a series of single outputs, wherein each output in the series has a different frequency. If, for example, a sine wave having frequencies of 50 and 400 Hz is generated by modulator 1101, the output frequency produced by function generator 1102 will vary sinusoidally between two values, 50 and 400 Hz, in this case. In the case of a two frequency square wave input from modulator 1101, the output frequency produced by function generator 1102 varies between high and low values (e.g., 100 and 400 Hz) at the frequency set by the input modulation. Other waveforms could be used as inputs to function generator 1102, for example, multi-step functions such as low, medium and high voltages with various durations, which would apply bursts of different frequencies at corresponding durations.

In another embodiment, three or more different frequencies are applied to function generator 1102 by modulator 1101 in a nearly simultaneously manner, for example, 100, 200, 300 and 400 Hz, to produce an output 1103 having four separate, recurring frequency components equivalent to the applied frequencies. It should be noted that other combinations of frequencies may also be advantageously utilized to provide an effective and relatively uniform illumination of an electroluminescent panel in accordance with the method described herein. In each of the embodiments illustrated by FIG. 11, the frequency that effectively controls the light output is determined by the RC time constant of the EL panel circuit. For electroluminescent panels having higher time constants, a lower frequency is operational, for panels having lower time constants, a higher frequency is operational.

The above described electroluminescent panels can be utilized in a variety of functions. For example, the panels can be used as a display panel for a vending machine, a display panel for an ice machine, an illuminated panel for a helmet, a road panel, a display panel in games of chance, e.g., slot machines, and as point of purchase panelage. It is to be noted that he above described electroluminescent controller may be used to drive EL lamps and panels other than those specifically described in this document. In addition, voltages and frequencies other than those specifically set forth herein may also be employed by the controller in accordance with the spirit of the present invention. The embodiments described above are exemplary and are not meant to be limiting.

What is claimed is:

1. A method for driving an electroluminescent lamp comprising the steps of:

applying a pulse train to the lamp to cause the illumination thereof;

sampling the current flowing through the lamp to generate a sample thereof;

determining from the sample if the current decayed to a reference value;

decreasing the frequency of the pulse train by a predetermined frequency value if the current did not decay to the reference value.

2. The method of claim 1, wherein the pulse train comprises a square wave.

3. The method of claim 2, including the additional step of clipping the negative-going portion of the sample prior to the determining step so that only the positive portion thereof remains.

4. The method of claim 1, wherein the step of decreasing the frequency is performed if the current did not decay to the reference value during a positive portion of a pulse in the pulse train.

5. The method of claim 1, wherein:

the determining step is performed by a differential amplifier that outputs a signal indicative of an instance of said sample that did not decay to the reference value; and the step of decreasing the frequency includes applying the signal to a voltage-to-frequency converter to effect a decrease in the frequency of the pulse train.

6. The method of claim 5, wherein the step of decreasing the frequency includes applying an output from the voltage-to-frequency converter to a power amplifier to generate the pulse train.

7. The method of claim 1, wherein the pulse train comprises a waveform selected from the group consisting of a square wave, a sine wave, a sawtooth, and a triangle waveform.

8. A method for illuminating an electroluminescent lamp panel comprising the steps of:

generating a drive signal at a drive frequency;

applying the drive signal to the lamp panel;

sampling the current flowing through the lamp panel to generate a sample thereof;

comparing the sample of the current with a reference value to determine if the current is approximately equal to the reference value; and if the current is not approximately equal to the reference value within a predetermined period of time, then decreasing the drive frequency by a predetermined value.

9. The method of claim 8, wherein the drive signal comprises a pulse train, and wherein:

the comparing step includes:

generating an adjustment signal having a first value indicating that the current has a value greater than to the reference value at a time relative to a predetermined part of the pulse width of a pulse in the pulse train; and generating the adjustment signal with a second value indicating that the current has a value less than the reference value at a time relative to a predetermined part of the pulse width of a pulse in the pulse train;

and the step of decreasing the drive frequency includes:

applying the adjustment signal to a voltage-to-frequency converter, wherein the adjustment signal having said first value causes the converter to decrease the magnitude of the frequency output therefrom; and wherein the adjustment signal having said second value causes the converter to increase the magnitude of the frequency output therefrom;

applying the output of the voltage-to-frequency converter to a power amplifier to modulate the drive frequency thereof; and driving the lamp panel by applying the output of the amplifier thereto.

10. The method of claim 9, wherein the pulse train comprises a square wave.

11. The method of claim 9, wherein the pulse train comprises a waveform selected from the group consisting of a sine wave, a sawtooth, and a triangle waveform.

12. The method of claim 9, including the additional step of clipping the negative-going portion of the waveform of the sample prior to the comparing step so that only the positive portion thereof remains.

13. A system for driving an electroluminescent lamp comprising:

a power amplifier coupled to the lamp for applying a waveform thereto;

a current follower, coupled between the power amplifier and the panel, for measuring the current flowing through the lamp;

a differential amplifier, coupled to the current follower, for producing an output responsive to a difference between said current and a reference value; and a voltage-to-frequency converter, coupled between the differential amplifier and the power amplifier, to modulate the output of the power amplifier;

wherein, in response to an output from the differential amplifier indicating that said current did not reach said reference value, a signal is applied by the voltage-to-frequency converter to the power amplifier, thereby causing a corresponding decrease in the frequency of the waveform applied by the power amplifier to the lamp.

14. The system of claim 13, further comprising a variable gain amplifier, coupled between the differential amplifier and the voltage-to-frequency converter, adjusted such that its output falls with in the input voltage range of the voltage-to-frequency converter.

15. The system of claim 13, further comprising means, coupled between the current follower and the differential amplifier, for clipping the negative-going portion of the waveform of the sample so that only the positive portion thereof remains.

16. A controller for illuminating an electroluminescent lamp panel comprising:

a power amplifier coupled to the electroluminescent lamp for applying a pulse train thereto;

a current follower, coupled between the power amplifier and the panel, for measuring the current flowing through the lamp;

a differential amplifier, coupled to the current follower, for producing an output responsive to a difference between said current and a reference value;

a voltage-to-frequency converter, coupled between the differential amplifier and the power amplifier, to modulate the output of the power amplifier; and a variable gain amplifier, coupled between the differential amplifier and the voltage-to-frequency converter, adjusted such that its output falls with in the input voltage range of the voltage-to-frequency converter;

wherein, in response to an output from the differential amplifier indicating that said current was not approximately equal to the reference value within a predetermined period of time, a signal is applied by the voltage-to-frequency converter to the power amplifier to cause a corresponding decrease in the frequency of the pulse train applied by the power amplifier to the lamp.

17. The controller of claim 16, wherein the current follower is coupled to a resistive load coupled between the power amplifier and the lamp.

18. The controller of claim 16, further comprising means, coupled between the current follower and the differential amplifier, for clipping the negative-going portion of the waveform of the sample so that only the positive portion thereof remains.

19. The controller of claim 16, wherein:

the differential amplifier generates, at a time relative to a predetermined part of the pulse width of a pulse in the pulse train, an adjustment signal having either a first value indicating that, the current has a value greater than to the reference value, or a second value indicating that the current has a value less than the reference value; and the voltage-to-frequency converter increases the frequency of the output therefrom to decrease the drive frequency of the power amplifier when the adjustment signal having said second value is applied to the converter, or increases the frequency of the output therefrom to decrease the drive frequency of the power amplifier when the adjustment signal having said second value is applied to the converter.

20. A method for illuminating an electroluminescent lamp comprising the step of:

applying a repetitively generated series of single waveforms, each waveform in the series having a different frequency, to the lamp.

21. A method for driving an electroluminescent lamp comprising the steps of:

generating a pulse train comprising a plurality of multiplexed waveforms to the electroluminescent lamp, wherein each of the waveforms has a different frequency; and applying said pulse train to the electroluminescent lamp.

22. The method of claim 21, wherein the plurality of multiplexed waveforms comprises two different frequencies.

23. The method of claim 21, wherein the plurality of multiplexed waveforms comprises at least three different frequencies.

24. The method of claim 23, wherein at least one of the plurality of multiplexed waveforms is of a different amplitude than one of the other waveforms.

25. The method of claim 21, wherein each of the plurality of multiplexed waveforms comprises a square wave.

26. The method of claim 21, wherein each of the plurality of multiplexed waveforms comprises a waveform selected from the group consisting of a sine wave, a sawtooth, and a triangle waveform.

27. The method of claim 21, wherein each of the plurality of multiplexed waveforms has a duration of approximately 100 milliseconds.

28. A method for illuminating an electroluminescent lamp comprising the steps of:

generating a modulated signal by using a plurality of frequencies to modulate a waveform; wherein each of the frequencies is cyclically applied seriatim to the waveform; and applying the modulated signal to the electroluminescent lamp to cause the illumination thereof.

29. The method of claim 28, wherein the plurality of frequencies comprises at least three different frequencies.

30. The method of claim 28, wherein the waveform comprises a square wave.

31. The method of claim 28, wherein the waveform comprises a waveform selected from the group consisting of a sine wave, a sawtooth, and a triangle waveform.

32. The method of claim 28, wherein each of the plurality of frequencies applied to the waveform has a duration of approximately 100 milliseconds.

33. Apparatus for illuminating an electroluminescent lamp comprising:

a modulator producing an output comprising a plurality of frequencies occurring in a cyclic, seriatim manner; and a function generator, coupled to the output of the modulator, generating a waveform upon which each of the plurality of frequencies are superimposed;

wherein the waveform is applied to the electroluminescent lamp to cause the illumination thereof.

34. The apparatus of claim 33, wherein each of the plurality of frequencies is generated for a duration of approximately 100 milliseconds.

35. The apparatus of claim 33, wherein the plurality of frequencies comprises at least three different frequencies.

36. The apparatus of claim 33, wherein the waveform is a square wave.

37. The apparatus of claim 33, wherein the waveform is a waveform selected from the group consisting of a sine wave, a sawtooth, and a triangle waveform.

* * * * *